US007059490B2

(12) United States Patent
Son

(10) Patent No.: US 7,059,490 B2
(45) Date of Patent: Jun. 13, 2006

(54) BEVERAGE CAN LID WITH ARTICULATED NECK

(76) Inventor: Paul Son, 6, Rue Victor Libert, Marche-en Famenne (BE) 6900

( * ) Notice: Subject to any disclaimer, the term of this patent is extended or adjusted under 35 U.S.C. 154(b) by 0 days.

(21) Appl. No.: 10/498,897

(22) PCT Filed: Dec. 13, 2002

(86) PCT No.: PCT/BE02/00190

§ 371 (c)(1),
(2), (4) Date: Jun. 16, 2004

(87) PCT Pub. No.: WO03/051733

PCT Pub. Date: Jun. 26, 2003

(65) Prior Publication Data

US 2005/0040169 A1 Feb. 24, 2005

(30) Foreign Application Priority Data

Dec. 17, 2001 (BE) ..... 2001/0820

(51) Int. Cl.
*A47G 19/00* (2006.01)

(52) U.S. Cl. ..... 220/254.3; 220/705; 222/534

(58) Field of Classification Search ..... 220/245.3, 220/254.4, 705, 708, 711, 715, 717; 222/529–530, 222/527, 534–536; 215/229, 388
See application file for complete search history.

(56) References Cited

U.S. PATENT DOCUMENTS

| | | | | |
|---|---|---|---|---|
| 5,188,283 | A * | 2/1993 | Gu | 229/103.1 |
| 5,203,468 | A * | 4/1993 | Hsu | 220/254.3 |
| 5,392,968 | A * | 2/1995 | Dark | 222/529 |
| 5,884,793 | A | 3/1999 | Wang | |
| 6,116,446 | A * | 9/2000 | Haughton et al. | 215/355 |
| 6,116,458 | A * | 9/2000 | Dark | 220/709 |
| 6,237,817 | B1 | 5/2001 | Son | |
| 6,279,773 | B1 * | 8/2001 | Kiyota | 220/709 |

FOREIGN PATENT DOCUMENTS

| | | |
|---|---|---|
| DE | 27 31 777 | 2/1979 |
| GB | 2 143 496 | 2/1985 |

* cited by examiner

*Primary Examiner*—Lien M. Ngo
(74) *Attorney, Agent, or Firm*—Young & Thompson

(57) ABSTRACT

A beverage can lid (10) is provided with an articulated neck (15) which can be lifted after partly tearing a closure seal (13) to drink the beverage contained in the can and which can be then folded down together with the seal so as to close hermetically the can to preserve the remaining part of the beverage for subsequent consumption.

10 Claims, 5 Drawing Sheets

BEVERAGE CAN LID WITH ARTICULATED NECK

FIELD OF THE INVENTION

The present invention relates to drinks cans equipped with a closing cap and a spout. It has to do in particular with a lid for such cans.

PRIOR ART

When a consumer wishes to drink directly out of a can after removing the closing cap, he must usually place his lips against the outer surface of the can. This outer surface is usually contaminated with all kinds of dirt and pollution resulting from warehousing and handling of various kinds during packaging, transport and storage of the cans.

In the distribution networks, too, the cans are handled repeatedly by different people. In supermarket refrigerators, for example, the cans are handled by a large number of people, typically to check them for coolness. Furthermore, the cans are often set down on the ground and are thus within the reach of animals or can come into contact with chemicals, detritus, grease, oils, etc. All this means that drinks cans currently on the market are of doubtful hygiene. Besides this, when a consumer, especially a child, drinks directly from the can, it is not uncommon for him to injure his lips or tongue.

In order to prevent the can from being contaminated with various kinds of dirt and pollution and to allow the consumer to drink directly from the can in a sanitary condition, it has already been proposed to fit cans with a spout member that flips out when the cap is detached from the lid.

For example, Publication U.S. Pat. No. 4,407,425, for instance, describes a container lid comprising a tubular component folded up underneath the detachable cap, that flips out when the cap is detached from the lid. That lid does not allow reclosure of the can after it has been opened.

However, with drinks containers or cans, even if equipped with a spout that flips out when the closing cap is detached from the lid, there is presently the problem that when the contents of the container are not all drunk in one go, it is not really possible to reclose the container hermetically. Furthermore, the flow through the spout is not always excellent and it is therefore often difficult to empty the container completely. Also, when the spout is flipped up out of the can, some of the drink is often spilled onto the top surface of the can or into the lip usually present on the can lid.

Publication WO-0059795 describes a lid equipped with a removable spout arranged in such a way as to be able to pivot between a down position and an up position and vice-versa, and a closing cap that makes it possible to recluse the cap after it has been opened. However, the spout provided on this lid is to be fixed to the base of the lid and must therefore be fabricated separately. For fixing the spout to the lid base it is necessary to provide hinge elements that should be molded together with the base of the lid and that should be placed in an precise position. The manufacturing tolerances do not secure an always perfect fixation after it has been moved once or twice towards its up position. In addition, it has been observed that the tightness at the junction of the spout with the lid is not optimal. Lastly, the fabrication of that lid requires three components to be assembled.

SUMMARY OF THE INVENTION

The invention seeks to remedy the disadvantages of known lids equipped with a flip-up spout while at the same time simplifying the manufacture of the lid and the assembly of the lid to a can for holding drinks.

An object of the invention is a novel and flat beverage can lid that is equipped with an articulated spout that flips out of the can to allow drinking of the beverage contained in the can and that can thereafter be folded down to allow hermetic reclosing of the can to hold the remaining beverage for later consumption.

Another object of the invention is a beverage can lid that is equipped with a closing cap and with a spout that flips out of a can to allow the can to be emptied and that is designed in such a way as to avoid spillages and splashes of liquid when the cap is partly detached from the lid.

Yet another object of the invention is a beverage can lid equipped with a closing cap that can be reclosed after it has been opened and with an articulated spout and that can be fabricated in one piece and easily on an industrial line.

The beverage can lid according to the invention comprises a flat portion having a cavity formed in the center portion thereof, said cavity having a generally oblong shape, said cavity having a bottom with an opening therethrough. A closing cap is attached to the flat portion by a hinge element at one end thereof. A rigid spout is attached to the lateral wall of the cavity so as to be able to pivot between a down position inside the cavity and an up position towards the exterior of the flat portion. A flexible sealing membrane connects a portion of the perimeter of the opening through the bottom of the cavity to the portion of the perimeter of the spout that is not attached to the lateral wall of the cavity. When the spout in its down position, an extremity thereof is in contact against the cavity lateral wall to which it is connected in such a way that, in that position of the spout, its internal channel is not in communication with the interior of the can. On the contrary, when the spout is in its up position, its internal channel is in communication with the interior of the can through a free passageway that is freed by the flexible membrane, which allows a consumer to drink out the contents of the can by placing his lips against the free end of the spout.

The design of the lid according to the invention allows the spout to be folded back and the cap to be reclosed after the spout placed in its upper position for drinking out the contents of the can on which it is placed. The can can be reclosed when its contents has not all been drunk at once. This prevents the ingress of insects or rubbish of any sort inside the can and into the beverage. The lid is advantageously provided with air holes for excellent pouring of the liquid through the spout and satisfactory emptying of the can. Furthermore, the lid is perfectly flat and it thus has the advantage of not modifying the normal external dimensions of usual cans, and they can therefore still be stored in ordinary automatic dispensers.

Other characteristics and advantages of the invention will become clearer on reading the following description, which refers to the attached drawings.

DESCRIPTION OF AN EMBODIMENT

FIG. 1 to FIG. 4 show an example of a beverage can lid according to the invention. The lid 10 comprises a generally flat portion 11 with a peripheral lip 12 integral with a ring 12A serving for fixing the lid to a can (not represented). The flat portion 11 is advantageously made of a synthetic material and the ring 15 is made of any material, for example from aluminum or other metallic or non metallic material. Fixing the lid to a can is effected for example by crimping.

Figure 1:
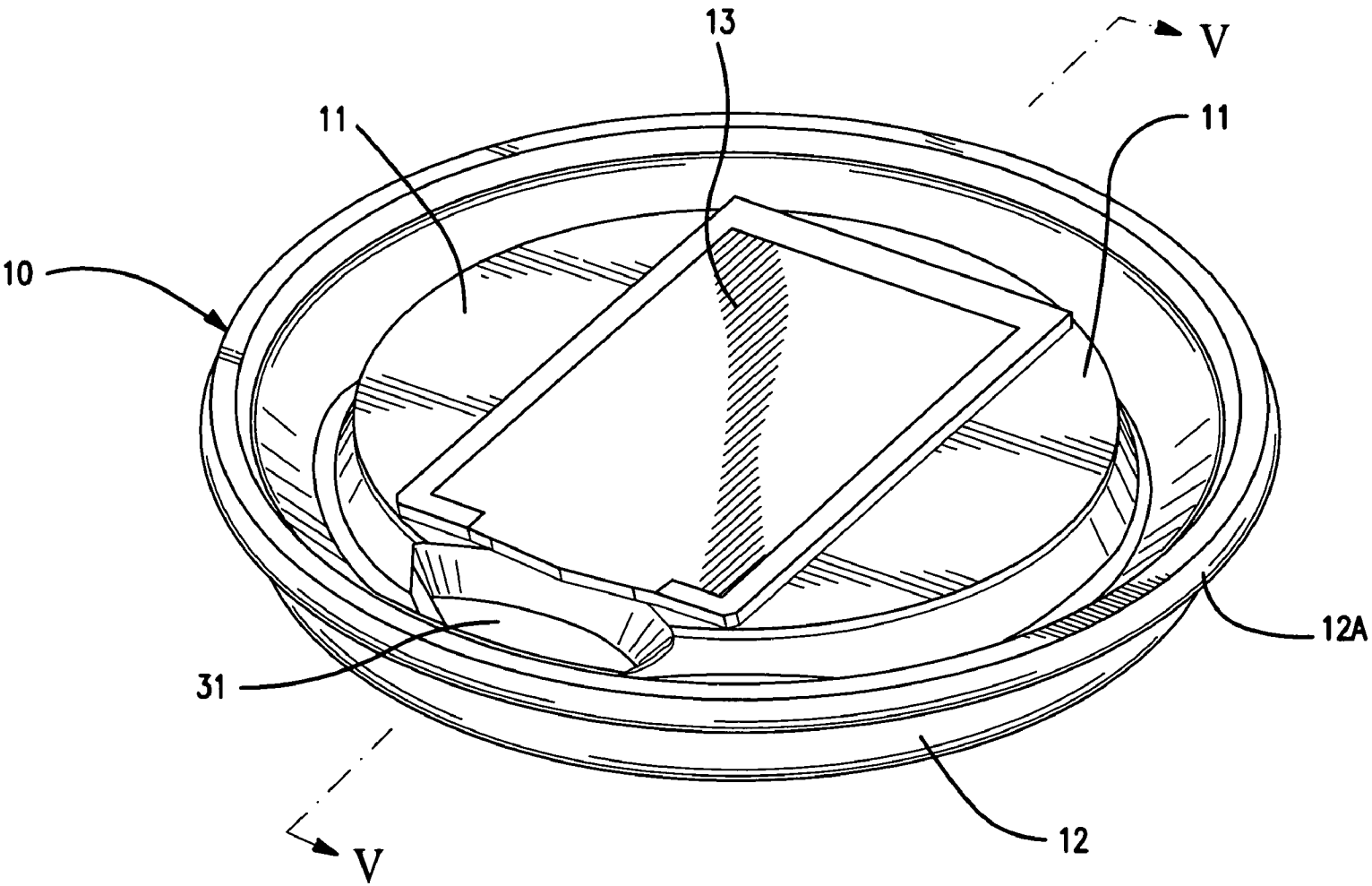
FIG. 1 is a perspective view of a beverage can lid according to the invention, with cap closed.
Figure 2:
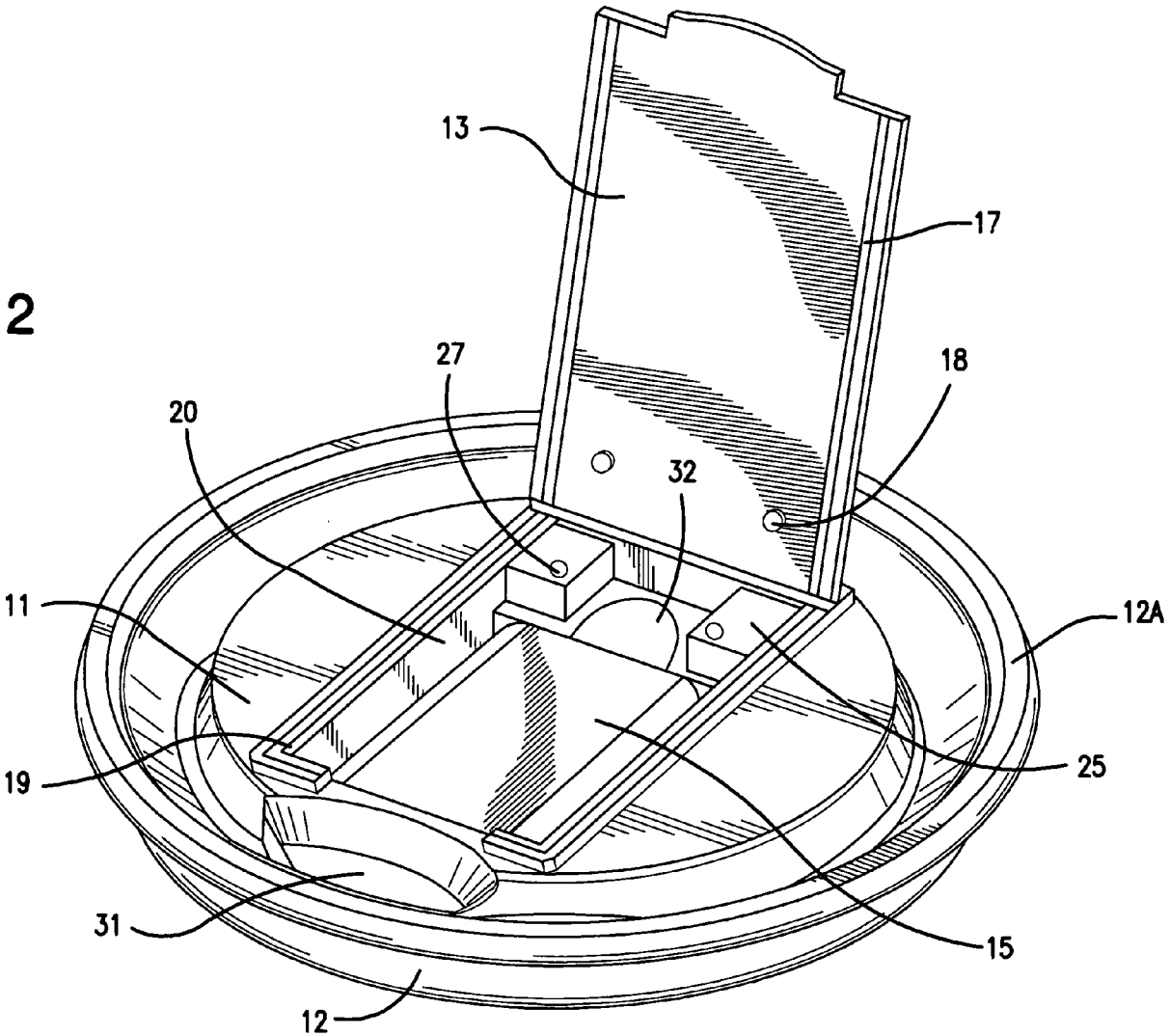
FIG. 2 shows the lid of FIG. 1 with the closing cap in an up position.

The flat portion 11 comprises a closing cap 13, having a generally rectangular shape, that can be torn along three of its side and can be raised in a raised position by being pivoted around its fourth side by which it is attached to the flat portion 11 by a hinge element 14 (FIG. 2). A recess 31 formed in the flat portion 11 facilitates the tearing-off of the cap to bring it in a raised position. When it is in a raised position, the cap 13 exposes a cavity 20, having a generally rectangular shape, formed in the center of the flat portion 11 and in which is housed a spout 15 integral with the lateral wall of the cavity 20 and with the flat portion 11.

On its inner face, the cap 13 advantageously presents tightening strips 17 made of an elastomer, placed in such a way as to engage with a projecting lip formed on the flat portion 11 along the perimeter of the cavity 20 and thereby ensure a perfect tightness when the cap 13 is folded back after it has been raised. Between the lateral wall situated at the extremity of the cavity 20 where the spout is attached and the free end of the spout 13 in a down position, the bottom of the cavity exhibits a projecting portion 23. On this projecting portion are formed two shoulders 25 that are pierced each by a hole 27 for the ingress of air or gas into the can. The air holes may be in any number. The air holes are sealed by the cap 13 when it is in a folded down position by toes 18 formed on the inner face of the cap 13, for example. The shoulders 25 and/or toes 18 are preferably coated with an elastomer to ensure a perfect tightness. When the cap is in a raised position, the air holes 27 are free and allow the ingress of air into the can. This allows the liquid contained in the can to be under atmospheric pressure and facilitates emptying the can.

Figure 3:
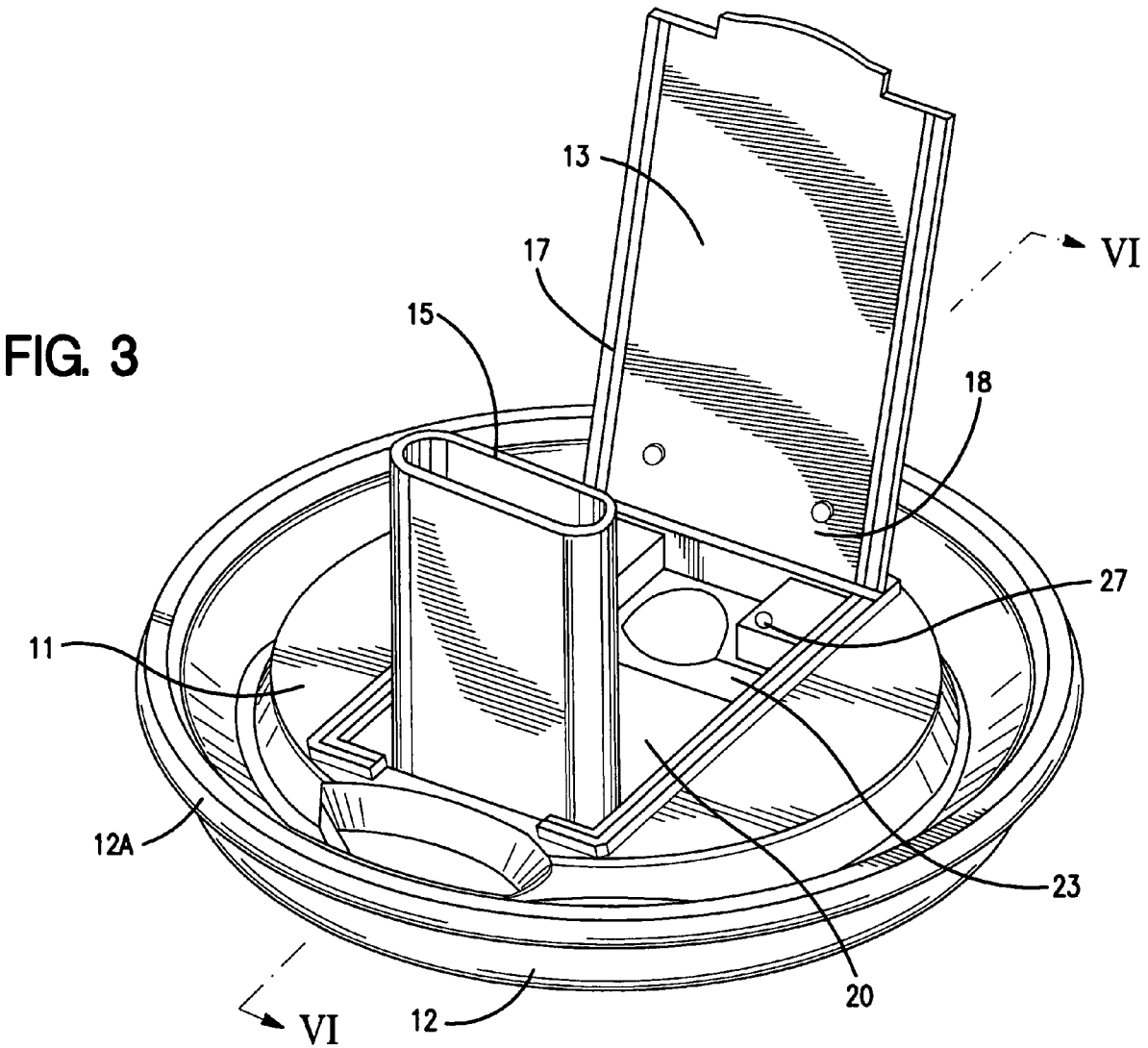
FIG. 3 shows the lid of FIG.2 with the spout in the up position.

The spout 15 is preferably a rigid flat tube of sufficient cross section to allow a good outflow of liquid and complete emptying of the can on which the lid will be placed. One end of the spout 15 is attached along a part of its perimeter to the lateral wall 21 of the cavity by a hinge element 16 made for example of an elastomer. The hinge element 16 permits the spout to be pivoted between a down position (FIG. 2) and an up position in which the spout stands up from the flat portion 11 (FIG. 3).

In the embodiment illustrated by way of example in the drawings, the hinge element 16 is located at the extremity of the cavity that is opposite to that at which the hinge element 14 which connects the spout 13 to the flat portion 11. A recess 32 in the bottom of the cavity 20 facilitates access to the free end of the spout for raising it to its up position.

Figure 4:
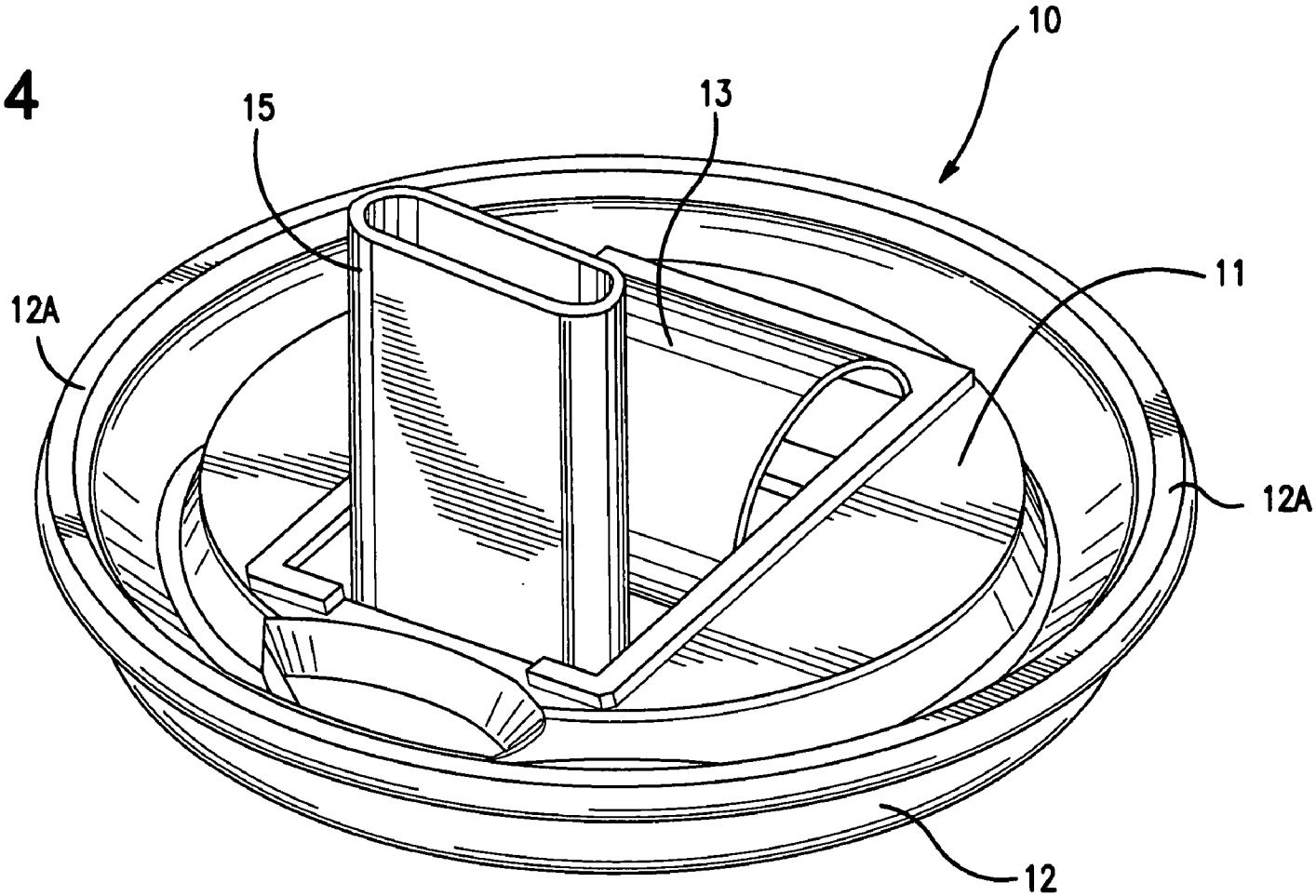
FIG. 4 illustrates an embodiment in which the closing cap has been folded down while the spout is still in the up position.

In an advantageous embodiment illustrated in FIG.4, the cap is arranged so as to be able to folded down while the spout 15 is in its up position and, by virtue of a certain flexibility, to be maintained in a curved position so as not to get in the way of placing the outlet of the spout in the mouth to drinking the contents of the can. Retaining means can be provided to that effect on the edge of the cap or on the edge of the cavity.

Figure 5:
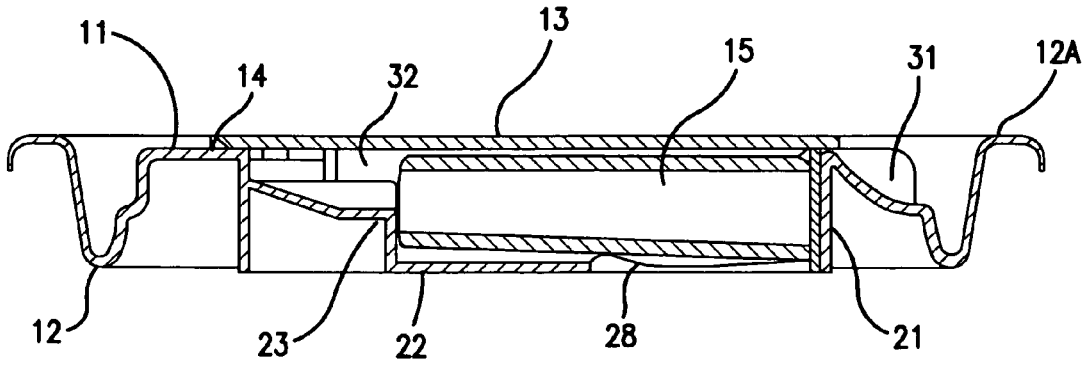
FIG. 5 is cross-sectional view along line V—V in FIG. 1.
Figure 6:
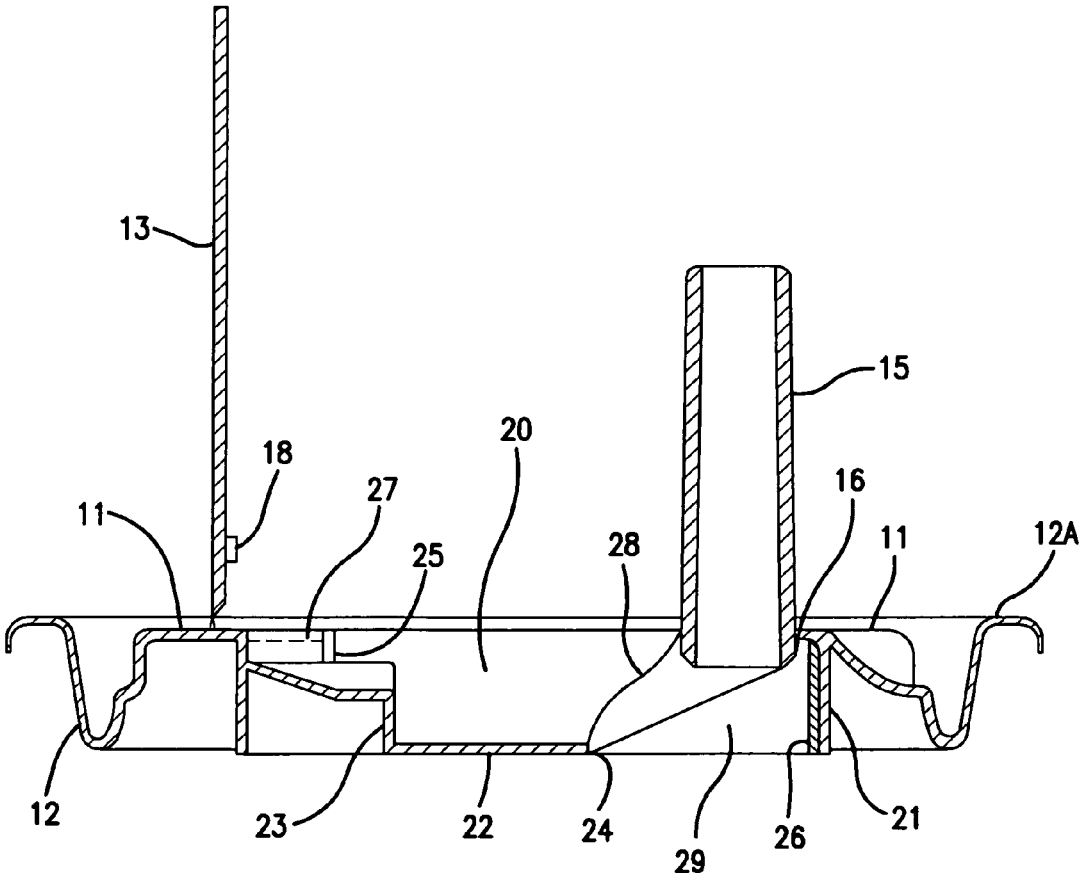
FIG. 6 is a cross-sectional view along line VI—VI in FIG. 3.

When in the down position, the spout 15 has its inner end located against the lateral wall 21 of the cavity 20 (FIG.5). The spout is preferably maintained in that position by a stud 26 formed on the lateral wall 21 of the cavity so as to cooperate with the lower end of the spout. On this end of the spout is advantageously formed a sealing joint, for example an elastomer packing. In that down position of the spout, its internal channel is not in communication with the inside of the can to which the lid is fixed and the liquid contained in the can is prevented entering the spout. This avoids any splashes and spillages of liquid when the spout is pivoted to its up position.

A flexible sealing membrane 28 connects the part of the perimeter of the spout 15 that is not attached to the lateral wall of the cavity 20, to a part of the perimeter of an opening 24 formed through the bottom 22 of the cavity. The flexible membrane 28 is folded on itself when the spout is in the down position and prevents any leakage of liquid along the spout 15. This ensures a perfectly hermetically sealing of the can to which the lid is fixed.

On the other hand, when the spout is in the up position, its lower end is disengaged from the lateral wall 21 of the cavity and the flexible membrane 28 uncovers the opening 24 through the bottom of the cavity 20, thus defining within the cavity 20, an environmentally sealed free passageway 29 between the interior of the can and the internal channel of the spout 15. As the consumer is drinking out the contents of the can by placing its lips on the free end of the spout and by inclining the can, no spillage of liquid can occur onto the top surface of the lid. In addition, the cross section of the funnel shaped free passageway facilitates the emptying of the can.

It will be observed that the top surface of the lid according to the invention is perfectly flat. This is to the advantage of the stability of the lid in beverage can filling machines. Furthermore, the perfectly flat top of the lid allows the cans to be stacked on top of each other. On the other hand, when in the up position, the cap 13 remains attached to the lid by the hinge element 14 and does project from the perimeter of the can. This allows the can to be put down on supports currently provided for this purpose in vehicles. Moreover, as shown in FIG.4, the cap can be folded down in such a way as to not get in the way of holding the can in the hand and not get in the way of placing the outlet of the spout in the mouth to drink the contents of the can.

Because the spout 15 remains protected underneath the cap 13 until the latter is opened, it is always of food grade and can therefore be placed in the mouth with no risk of contamination for the consumer. Moreover, the spout made of a synthetic material does not cut and does not scratch the consumer's fingers.

When the consumer does not drink all the contents of the can at once, it is possible for him to replace the spout in its down position and then close the cap again. The can is then once again hermetically sealed, which avoids the risk of insects, cigarette-ends, dust particles or any other rubbish from getting into the can. Both the spout and the contents of the can therefore remain unexposed to an external contamination.

The lid according to the inventionis easy to manufacture in one piece by molding. When a metallic ring is used for fixing the lid to a can, the part make of synthetic material can be assembled with the ring by duplicate molding or overmolding for example. The lid is fixed to a can by crimping around the edge of the opening of the can body.

It will be understood that the embodiment illustrated in the drawings and described above is only one example of an embodiment in accordance with the invention and that the latter is in no way limited to this example of an embodiment.

That is claimed is:

1. A beverage can lid comprising:

a flat portion having a cavity formed therein; said cavity having a generally oblong shape, a lateral wall, and a bottom; said bottom having a first portion with an opening therethrough and a second portion pierced with at least one air hole;

a closing cap attached to said flat portion by a hinge element at one extremity of said cavity so as to be able to pivot between a down closed position and an up open position; said closing cap having means to seal said air hole when said cap is in said closed position;

a rigid spout having a first free end and a second end attached to said lateral wall of the cavity by a hinge element so as to be able to pivot between a down position in which its second end is located against said lateral wall of the cavity, and an up position towards the exterior of said flat portion; and a flexible sealing membrane connecting a part of the perimeter of said opening to the part of the perimeter of said spout that is not attached to said lateral wall of the cavity.

2. The lid according to claim 1, wherein said lid is molded in one piece.

3. The lid according to claim 1, wherein said lateral wall of the cavity to which said spout is attached comprises means formed thereon for cooperating with the second end of said spout so as to maintain the spout in the down position.

4. The lid according to claim 1, wherein said closing cap presents on its inner face sealing means located in such a way as to engage with a projecting lip formed on the outer surface of said flat portion.

5. The lid according to claim 1, wherein said closing cap or said flat portion comprises means for maintaining the cap in a curved down position while said spout is in an up position.

6. The lid according to claim 1, wherein said flat portion has a peripheral lip, integral with a ring for fixing the lid to a beverage can.

7. A beverage can including a lid that comprises a flat portion having a cavity formed therein; said cavity having a generally oblong shape, a lateral wall and a bottom;

said bottom having a first portion with an opening therethrough and a second portion pierced with at least one air hole;

a closing cap attached to said flat portion by a hinge element at one extremity of said cavity so as to be able to pivot between a down closed position and an up open position; said closing cap having means to seal said air hole when said cap is in said closed position;

a rigid spout having a first free end and a second end attached to said lateral wall of the cavity by a hinge element so as to be able to pivot between a down position in which its second end is located against said lateral wall of the cavity, and an up position towards the exterior of said flat portion; and a flexible sealing membrane connecting a part of the perimeter of said opening to the part of the perimeter of the spout that is not attached to said lateral wall of the cavity.

8. The beverage can according to claim 7, wherein said lateral wall of the cavity to which said spout is attached comprises means formed thereon for cooperating with the second end of said spout so as to maintain the spout in the down position.

9. The beverage can according to claim 7, wherein said closing cap presents on its inner face sealing means located in such a way as to engage with a projecting lip formed on the outer surface of said flat portion.

10. The beverage can according to claim 7, wherein said closing cap or said flat portion comprises means for maintaining the cap in a curved down position while said spout is in an up position.

* * * * *